US005679035A

United States Patent [19]

Jordan

[11] Patent Number: 5,679,035

[45] Date of Patent: Oct. 21, 1997

[54] MARINE JET PROPULSION NOZZLE AND METHOD

[76] Inventor: Jeff P. Jordan, 3061 69th Ave. SE., Mercer Island, Wash. 98040

[21] Appl. No.: 607,972

[22] Filed: Feb. 29, 1996

Related U.S. Application Data

[63] Continuation-in-part of Ser. No. 576,891, Dec. 22, 1995.

[51] Int. Cl.[6] ..... B63H 11/103

[52] U.S. Cl. ..... 440/47; 60/221

[58] Field of Search ..... 440/38, 46, 47; 60/221

[56] References Cited

U.S. PATENT DOCUMENTS

| | | | |
|---|---|---|---|
| 3,214,903 | 11/1965 | Cochran | 440/47 |
| 3,314,391 | 4/1967 | Duport | 440/47 |
| 4,775,341 | 10/1988 | Tyler et al. | 440/38 |
| 5,244,425 | 9/1993 | Tasaki et al. | 440/47 |
| 5,338,234 | 8/1994 | Nanami | 440/38 |
| 5,401,198 | 3/1995 | Toyohara et al. | 440/47 |

FOREIGN PATENT DOCUMENTS

| | | | |
|---|---|---|---|
| 262290 | 10/1989 | Japan | 440/47 |
| 403213495 | 9/1991 | Japan | 440/47 |

*Primary Examiner*—Sherman Basinger
*Attorney, Agent, or Firm*—Robert M. Storwick

[57] ABSTRACT

An improved discharge nozzle and method for operating a marine jet propulsion system are disclosed designed to allow the pump to operate more efficiently. The discharge nozzle includes an outer nozzle structure mounted immediately downstream of the pump diffuser vanes which progressively reduces in diameter towards its rear exit opening. A needle is mounted within the diffuser hub and travels in axial alignment within the outer nozzle structure to adjust the effective opening of the discharge nozzle according to a pump affinity relationship, so that the pump is always operating at the most efficient head and flow for its current shaft RPM, regardless of boat speed or pressure recovery in the inlet duct. This is especially desirable when the discharge nozzle is used in combination with a large effective nozzle area, a large pump, and an inlet duct which is efficient in recovering the total dynamic head of the oncoming water at the inlet of the method discloses how the nozzle is used to allow the pump to operate more efficiently. A method for maintaining the pump efficiency of a jet propulsion system for a watercraft including an inlet duct, a pump, and an adjustable discharge nozzle is also disclosed.

8 Claims, 8 Drawing Sheets

MARINE JET PROPULSION NOZZLE AND METHOD

This is a continuation-in-part of copending application, Ser. No. 08/576,891 filed on Dec. 22, 1995.

BACKGROUND OF THE INVENTION

1. Field of the Invention

This invention relates to nozzles for forming water jets, and, more particularly, to improved nozzles for marine jet propulsion systems.

2. Description of the Related Art

A typical marine jet propulsion system includes an inlet duct, a pumping means, and a nozzle. The inlet duct delivers water from under the watercraft's hull to a low volume, high speed pumping means which is coupled to a gasoline powered, internal combustion engine. The pumping means forcibly delivers the water delivered through the inlet duct to a discharge nozzle which propels the watercraft through the body of water in which the watercraft moves.

Heretofore, high revolution, gasoline powered engines have been used in marine jet propulsion systems due to their lower costs, the availability of a wide variety of different horsepowers and their ability to be directly connected to a pumping means and to provide sufficient high RPM required by the pumping means. Due to the relatively high RPM produced by these engines, high speed pumping means are commonly used in such systems. Unfortunately, these high speed pumping means operate most efficiently when a small volume of water under relatively high pressure is delivered therethrough.

One goal of these manufacturers is to develop jet propulsion systems which are more efficient and provide improved performance and fuel economy. Heretofore, it has been generally accepted that the highest propulsion efficiency for a jet propulsion system is achieved when a large mass of water is accelerated a very small increment of velocity. In order to achieve high propulsion efficiency with jet propulsion systems, large pumping means and large diameter nozzles must be used. Unfortunately, these manufacturers have not been able to overcome the increased hydraulic inefficiencies which develop in the large pumping means and inlet ducts which offset any gains in propulsion efficiency.

In order to maintain efficient operation of large pumping means in combination with large diameter nozzles, the flow of water through the pumping means must be adjusted solely in accordance with the pumping means' shaft RPM. Also, any flow changes due to changing boat speed must be substantially eliminated. When boat speed increases from zero to 55 mph, the total dynamic head available for recovery in the inlet duct increases from zero to 100 feet. A typical 200 hp large pumping means is most efficient at full power when it is adding a 57 foot head to the inlet head. Hence, the head on the discharge nozzle potentially varies from 57 to 157 feet. Over this range of head, the effective nozzle diameter, which is the diameter of the actual jet produced, must be reduced from 8 inches to 6.5 inches in order to maintain constant flow through the discharge nozzle and thereby a constant 57 foot head on the pump feet. In practice, the largest effective nozzle diameter is limited to 7.5" because pump cavitation offsets any gain from the larger diameters.

When a boat operator increases the throttle from 25% to 100% at 30 mph, the shaft RPM typically rises 50%. The flow through the discharge nozzle must also rise 50% to maintain pump efficiency. In a large discharge nozzle system, the effective nozzle diameter must increase from about 6.6 inches to 7.3 inches to allow this increase in flow, while maintaining the most efficient head on the pump over this range of operation. This variation in effective nozzle diameter is almost equal to the variation required for the above cited change in boat speed from zero to 55 mph at full power. If the effective nozzle area is based on boat speed, this variation in nozzle area will not occur and pump efficiency will be substantially reduced.

It should be noted that power of the pumping means is the product of the head and flow, so that increasing system design flow in order to achieve increased propulsion efficiency reduces the design pump head. The head available for recovery in the inlet duct at any given boat speed is constant, but it becomes more important as the design pump head is reduced. In the 200 hp system discussed herein, the pump head is 57 feet, and the head recovered in the inlet duct is 95 feet at 55 mph. In the typical 200 hp system used in the prior art, the pump head is approximately 250 feet and the head recovered in the inlet duct is approximately 50 feet at 55 mph. The nozzle head varies from 57 to 152 feet in the large-nozzle system compared to a variation from 250 to 300 feet in the system of the prior art. The uncorrected flow variation in the large-nozzle system would be over 63%, whereas it is less than 10% in the typical system of the prior art. This demonstrates the relatively greater importance of effective nozzle size regulation to maintain pump efficiency in large-nozzle systems.

Heretofore, nozzles having variable effective area have been regulated according to the watercraft speed. For example, Nanami, (U.S. Pat. No. 5,338,234), discloses a nozzle area control system in which the nozzle area is based on maintaining the nozzle velocity at 1.8 times the boat speed. This mode of control is very close to the classic optimal efficiency for water jet propulsion systems in which there is no recovery of head in the inlet duct, which requires that nozzle velocity be maintained at 2.0 times the boat speed for optimal propulsion efficiency. This mode of control is unsuitable for systems employing efficient inlet ducts, which recover a large part of the available head in the inlet duct. When the throttle position or shaft RPM exceed preset limits or rates of increase, Nanami's control then switches to a computer program that adjusts the nozzle in anticipation of the setting required for the greatest instantaneous acceleration. While the system disclosed in Nanami may achieve this end, it is overly complex and does not result in the most efficient pump operation in any of its modes. It is therefore unsuitable for use with large-nozzle systems.

In order to achieve maximal operating efficiency of the pumping means, the system flow must be adjusted according to the pumping means' shaft RPM. Following hydraulic principles widely recognized in the art, system flow can only be efficiently regulated by varying the effective nozzle area. Systems which vary the cross section area of the flow "upstream of the nozzle", such as those disclosed by Tasaki et al., (U.S. Pat. No. 5,244,425) are demonstrably inefficient with incompressible fluids and lack utility. Adjusting the effective area of the nozzle based on boat speed results in peak pump efficiency at only one shaft RPM for each boat speed and does not achieve efficient pump operation at all useful shaft speeds and boat speeds. The invention disclosed herein discloses such an apparatus and method for achieving this end.

Devices of the prior art relating to small nozzles, which reduce the effective nozzle area with increasing boat speed, have an entirely different utility than does the adjustment of effective nozzle area to maintain pump efficiency in large nozzle systems. In the systems in the prior art, which employ small nozzles and inefficient inlet ducts, the reduction of effective nozzle area and the consequent reduction in system flow gain most by reducing power losses in the inlet duct, while having less effect on the operating efficiency of the pumping means. This can be seen by noting that power losses in the inlet duct are the product of the total dynamic head lost in the inlet duct and the system flow, so reducing system flow reduces the power losses that must be made up by the pumping means. The loss of total dynamic head in the inefficient inlet duct shown in the prior art is 10 times greater than in the efficient inlet duct essential to the large nozzle system. The uncorrected flow variation is only one-sixth as great, which has a small effect on the pumping means' efficiency.

SUMMARY OF THE INVENTION

It is an object of the invention to provide an improved discharge nozzle for a marine jet propulsion system.

It is another object of the present invention to provide a discharge nozzle with a sufficiently large effective nozzle opening which can be used with a large pumping means and efficient inlet duct to achieve higher propulsion efficiency than that currently available from marine jet propulsion systems.

It is another object of the present invention to provide such a discharge nozzle whereby the gain in propulsion efficiency achieved when used with a large pumping means is not offset by increased hydraulic inefficiencies in the pumping means.

It is a further object of the invention to provide such a discharge nozzle which can dynamically adjust to maintain efficient operation of the pumping means at all watercraft speeds and at all pumping means' shaft RPM, particularly when used in combination with an inlet duct which efficiently recovers the total dynamic head of the incoming water at the pumping means' inlet.

It is a still further object of the invention to provide a large inlet duct, a large impeller hub, and a large diffuser hub through which engine exhaust may be conveniently passed and discharged into the center of the jet for the purposes of reducing exhaust plumbing in the boat and reducing exhaust noise.

These and other objects are met by providing an improved discharge nozzle for a marine jet propulsion system designed to maintain the most efficient operation of the pumping means at all pumping means' shaft RPM and all watercraft speeds. This is especially important in marine jet propulsion systems which use a large pumping means and an efficient inlet duct capable of recovering the total dynamic head of the oncoming water. In order to achieve these objects, the discharge nozzle includes an adjustable nozzle means capable of adjusting the size of the discharge nozzle's effective nozzle opening so that the hydraulic conditions on the pumping means are optimized to the pumping means shaft's RPM.

In the embodiments disclosed herein, the discharge nozzle is shown with an adjustable needle mounted axially within a diffuser hub and is fitted with seals. A sealed needle chamber is created between the needle and the diffuser hub thereby enabling the needle to act as a hydraulic piston, which moves rearward when a control fluid is forced into the needle chamber. When the control fluid is released from the needle chamber, the pressure acting on the outside surface of the needle forces it to retract back into the diffuser hub and expel the control fluid therefrom.

A 3-way control valve is used to control the injection and release of the control fluid into and out of the needle chamber. The control valve contains a spool with a piston attached at one end disposed inside a cylinder. The piston is held in a center position by two biasing springs which closes the control valve and prevents the control fluid from flowing into or out of the needle chamber.

In the first embodiment, a pitot tube is positioned in front of the pumping means. During operation, water enters the pitot tube which creates a pressure that represents the total dynamic head in the inlet duct at the inlet to the pumping means. This pressure is then delivered to one side of the piston in the control valve. A pressure port is created on the nozzle which delivers the pressure after the pumping means to the opposite side of the piston in the control valve. The system is designed so that the pumping means is operating at its peak efficiency whenever the forces exerted on piston are equal. When the opposing forces are equal, the piston is centered in the cylinder by the biasing springs and the control valve is closed. The needle is also locked in place and the system is in a steady state, efficient operation.

When the pressures acting on the piston are imbalanced, a net motive force is created which moves the piston against one of the biasing springs proportionately to the magnitude of the imbalance. The movement of the piston opens the control valve and causes the needle to move to reduce the imbalance and restore the system to stable efficient operation.

In a second embodiment, the control valve is located outside the diffuser hub and controls a pressurized control fluid from a separate shaft driven control pump in order to actuate the needle. Three hydraulic pressures are then used to control the control valve.

The first two pressures applied to the control valve are the total dynamic head before and after the pumping means. The pitot tube pressure ahead of the pumping means is applied to one side of the piston to produce a force proportionate to the total dynamic head at the pumping means inlet. The pitot tube pressure after the pumping means' impeller is applied to the opposite side of the piston to create a force proportionate to the total dynamic head after the pumping means. The piston is arranged so that these forces act in opposition to produce a net force proportionate to the head on the jet propulsion system pumping means.

The third pressure is produced by the control pump which is driven by the motor. Since the pumping means is also driven by the motor, the pressure created by the control pump is proportionate to the square of the speed of the pump's shaft. This pressure is applied to the end plate to produce a force proportionate to the square of the shaft RPM which opposes the force proportionate to the head on the pumping means.

The size of the piston and pumping means are chosen so that forces exerted on the control valve are in balance when the jet propulsion system pump is operating at peak efficiency according to the pump affinity relationship $h=k_h N^2$. The operation of the control valve to actuate the needle and maintain this relationship is identical to that in the first embodiment.

In the third embodiment, a control valve and control pump are used similar to those used in the second embodiment. The difference is in the water pressures applied to the control valve. In this embodiment, a pitot tube and a pressure port are located in front of the pumping means in the same plane perpendicular to the flow direction. This plane is chosen so that the cross-sectional area of the flow is constant under all operating conditions. The pressure from the pitot tube is applied to one side of the piston located inside the control valve to produce a force proportionate to the total dynamic head. The pressure from the pressure port is applied to the opposite side of the piston located inside the control valve to produce a force proportionate to the pressure head. The resultant force is therefore proportionate to the velocity head $V^2/2g$, which is in turn proportionate to square of the flow Q through the constant cross-sectional area.

The size of the piston, the end plate, and the pumping means are chosen so that the forces exerted on the control valve are in balance when the jet propulsion system pump is operating at peak efficiency according to the relationship $Q^2=k_Q^2 N^2$, which is equivalent to the pump affinity relationship $Q=k_Q N$.

It should be understood that the adjustable needle may be replaced with other means for adjusting the effective nozzle opening in the discharge nozzle, such as shown in Nanami, (U.S. Pat. No. 5,338,234) and Tasaki, et al. (U.S. Pat. No. 5,244,425).

Using the above nozzle systems, an improved method for maintaining peak efficiency in the pumping means in a marine jet propulsion system is disclosed.

A method is also disclosed for discharging the engine exhaust through the large discharge nozzle.

DESCRIPTION OF THE PREFERRED EMBODIMENTS

Figure 1:
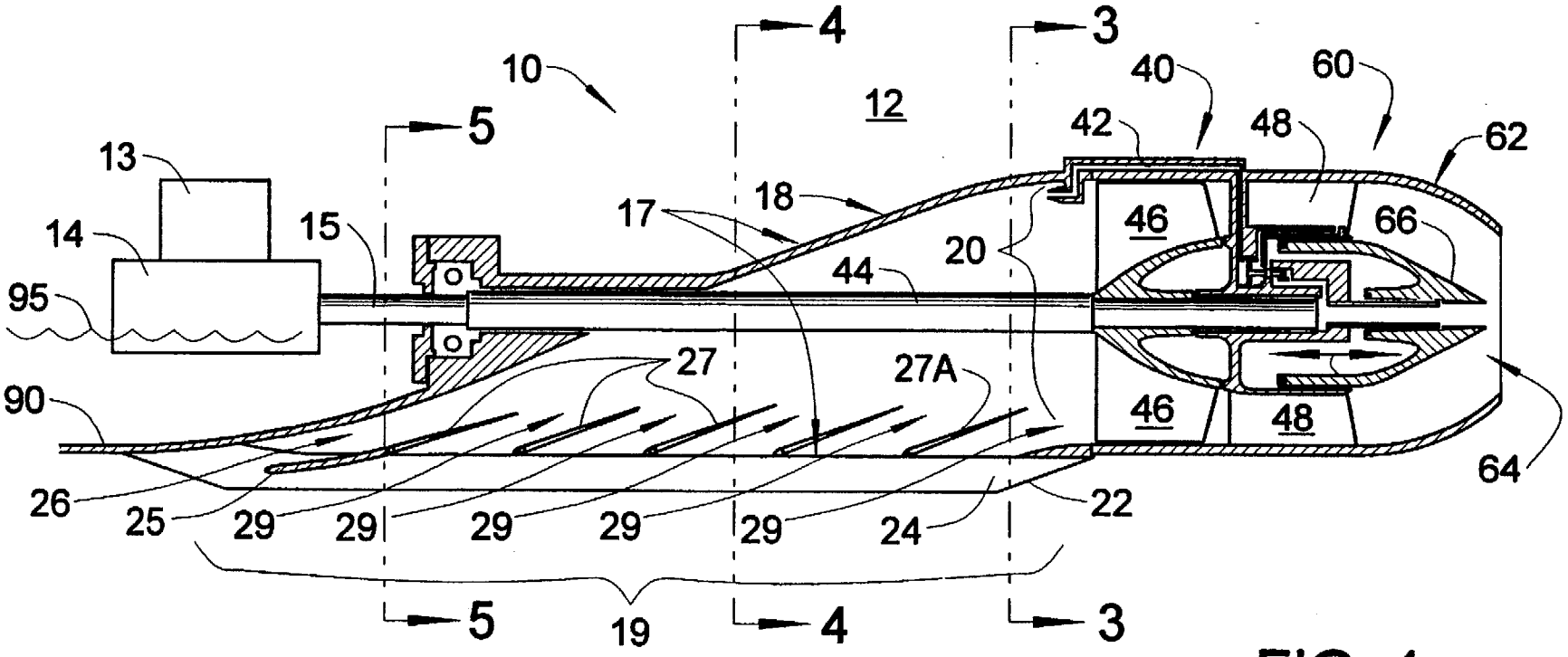
FIG. 1 is a sectional, side elevational view of a watercraft showing one embodiment of the nozzle with an axially traveling needle that is positioned by a hydraulic valve internal to the diffuser hub based on hydraulic conditions before and after the pump.
Figure 2:
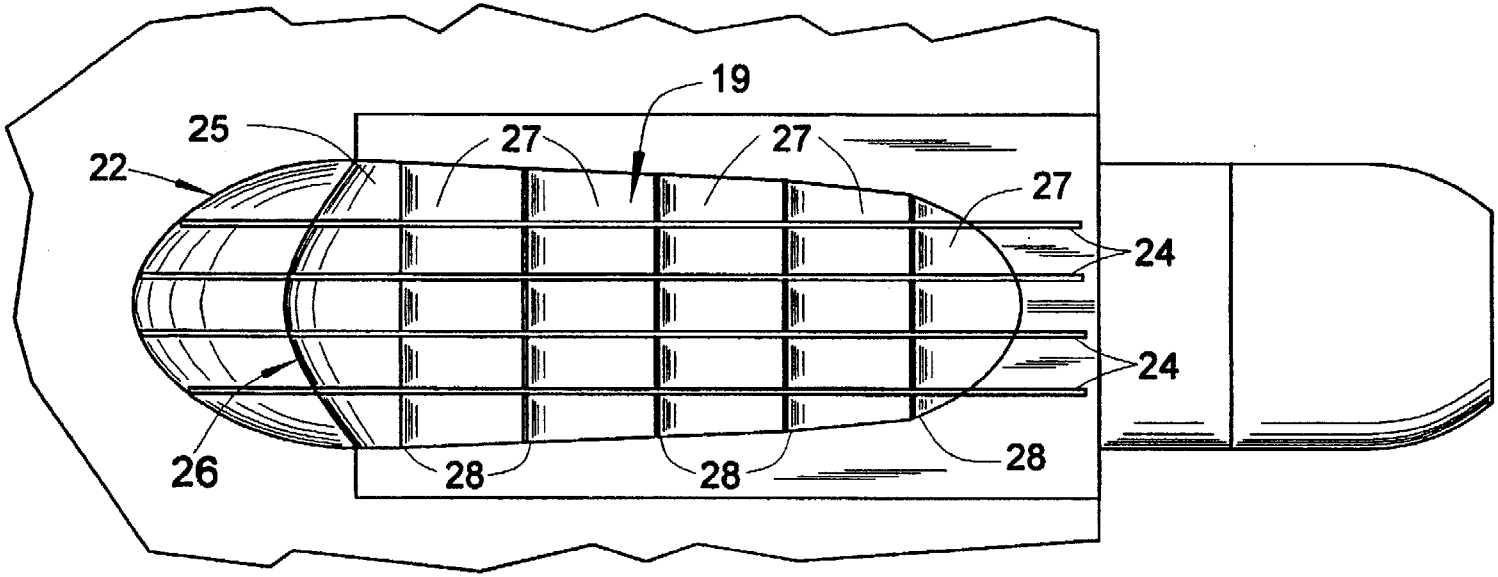
FIG. 2 is a bottom plan view of the inlet duct.
Figure 5:
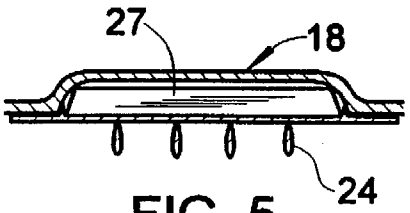
FIG. 5 is a sectional, end elevational view of the inlet tunnel region taken along line 5—5 in FIG. 1.
Figure 4:
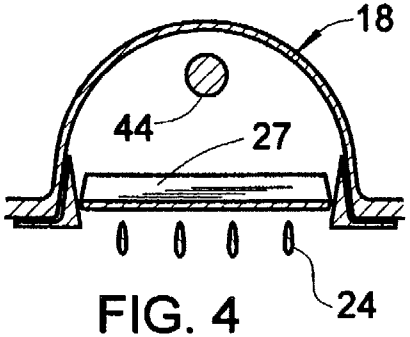
FIG. 4 is a sectional, end elevational view of the inlet tunnel region taken along line 4—4 in FIG. 1.
Figure 3:
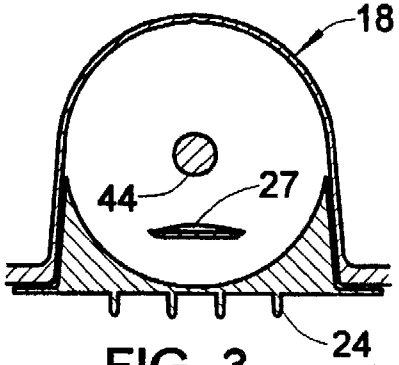
FIG. 3 is a sectional, end elevational view of the inlet tunnel region taken along line 3—3 in FIG. 1.
Figure 6:
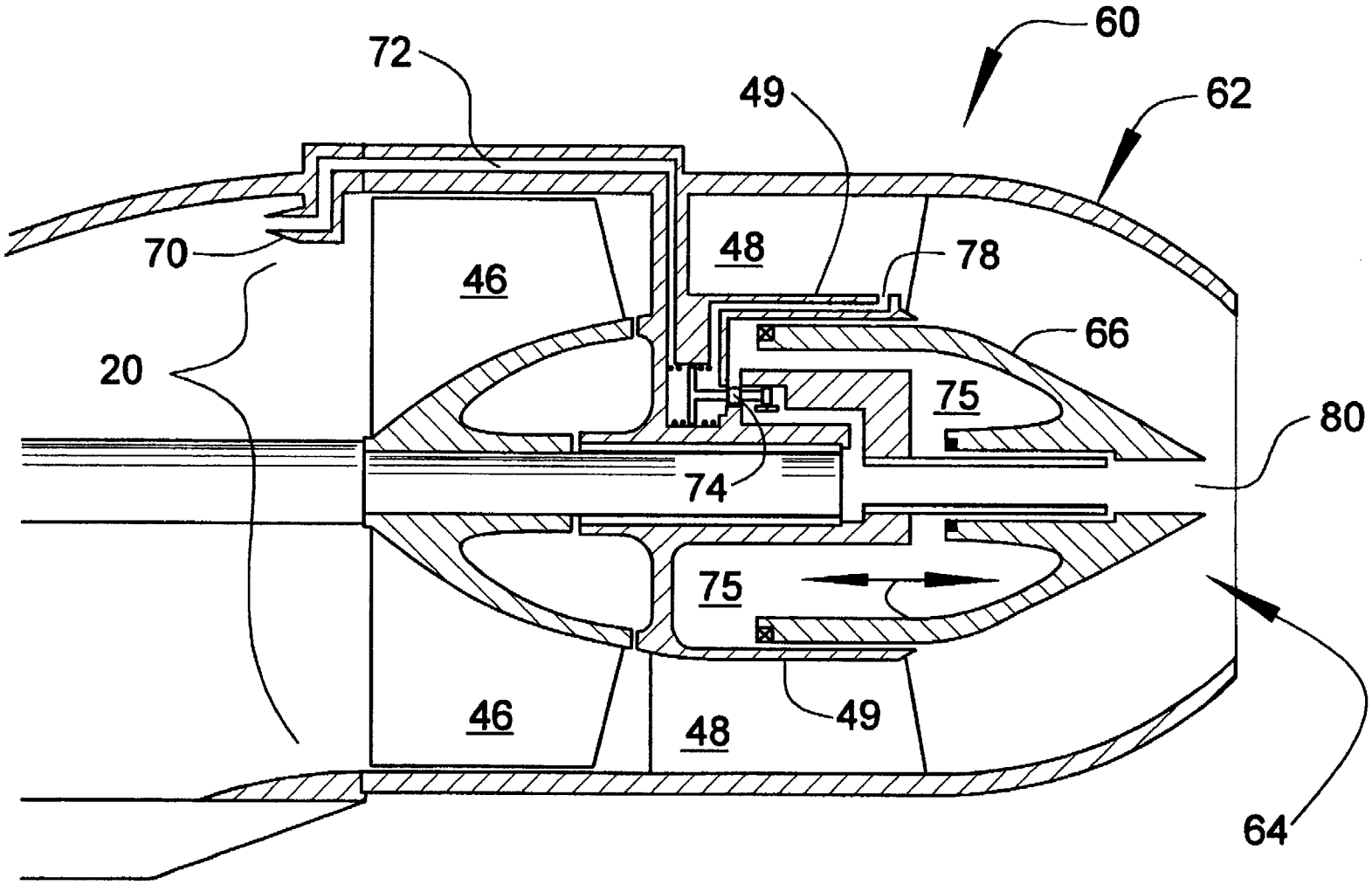
FIG. 6 is blown up partial side elevational view of the nozzle section of FIG. 1 showing the details of the needle and internal hydraulic controls with the needle in a retracted position in the discharge nozzle.

In the accompanying FIGS. 1–10, there is shown an improved marine jet propulsion system, generally referred to as 10, designed to achieve higher propulsion efficiency than currently available marine jet propulsion systems.

The system 10 includes a water inlet duct 17 for admitting water into the system 10, a large pump 40 capable of receiving and pumping a relatively large amount of incoming water, and an adjustable, large diameter discharge nozzle 60 capable of forcibly exiting the water pumped by the pump 40 to propel the watercraft 89 through the body of water 95. By using a large pump 40 and a large diameter discharge nozzle 60, the propulsion efficiency of the system 10 is greatly improved over marine jet propulsion systems found in the prior art.

The inlet duct 17 which has utility with both system 10 and with marine jet propulsion systems found in the prior art is designed to efficiently recover the total dynamic head of the incoming water at the pumping means at all pumping means' shaft RPM and all watercraft speeds. The inlet duct 17 includes a longitudinally aligned inlet tunnel 18 formed in or attached to the watercraft's hull. The inlet tunnel 18 is designed to draw incoming water therein for delivery to the pumping means.

It is well known in the turbine and venturi flow meter art fields that for efficient pressure recovery in an inlet duct of this type, five conditions must be met: (1) the hydraulic radius of the flow lines approaching the entrance opening of the duct must be kept large relative to the flow's cross section in order to minimize losses due to turbulence; (2) the effective vane entrance angles must match the angle of the relative velocity vector approaching the inlet duct, commonly called the angle of approach; (3) the velocity of the fluid flowing just inside the inlet duct must match the velocity of the fluid approaching the entrance opening to the inlet duct; (4) the change in cross-sectional area between the entrance opening and exit opening of the inlet duct must be gradual and proceed at a nearly constant rate in order to minimize the formation of swirls or eddies; and, (5) the hydraulic radius within the inlet duct must be kept large relative to the flow cross section. The inlet duct 17, disclosed herein is designed to meet these conditions.

The flow into the inlet tunnel can be conceptually divided into a plurality of partial flows, as is commonly done in the design of pumps and turbines. The first partial flow to enter the front entrance opening of the inlet tunnel 18 is located adjacent to the bottom of the watercraft's hull 90. After entering the front entrance opening, this partial flow continues upward and rearward to the pumping means.

It is widely known that the flow of water through the propulsion system must equal the product of the cross-sectional area of the inlet tunnel perpendicular to the flow lines and the velocity along the flow lines. When the pumping means is operated at a constant RPM, its most efficient flow is also constant. Increasing the watercraft's speed, leads to increased total dynamic head recovered in the inlet duct which appears at the nozzle. If left uncorrected, the flow through the discharge nozzle would increase which would reduce the pumping mean's efficiency. To prevent this, the effective nozzle area must be reduced to counter the increase in total dynamic head and to maintain constant flow through the pumping means.

As shown in FIG. 1, the inlet tunnel 18 is formed integrally in the hull 90 so that the streamlines of generation along the hull 90 forward to the inlet tunnel 18 bend gradually upward and rearward into the hull 90 to the inlet tunnel's rear exit opening 20. Inlet tunnel 18 gently curves upward into the hull 90 following the streamlines of flow gradually increasing in cross-sectional area from the fore to the aft positions. During use, water located along the hull is drawn upward into the front entrance opening 19 of the inlet tunnel 18. The surface of the hull 90 immediately adjacent to the front entrance opening 19 of the inlet tunnel 18 is tangentially curved so that turbulence is minimal.

In the embodiment shown herein, the articulating structure 22 is self-regulating and automatically adjusts the size of the front entrance opening 19 according to the difference in hydraulic conditions inside the inlet tunnel 18 and under the hull of the watercraft. By adjusting the flow of water into the inlet duct 19 so that the two hydraulic conditions are equal, the velocity of the incoming water therethrough matches the velocity of the watercraft 89 in the body of water 95 in which the watercraft moves. In the preferred embodiment, the articulating structure 22 is a grate-like structure which includes a plurality of spaced apart, longitudinally aligned elongated members 24, one transversely aligned fixed vane 25, and a plurality of spaced apart, transversely aligned floating vanes 27. A first vane opening 26 is created between the transitional region 23 of the articulating structure 22 and the fixed vane 25. The floating vanes 27 are pivotally attached along their leading edges 28 to the elongated members 24. The floating vanes 27 are spaced apart and aligned over the elongated members 24 so that an adjustable inlet openings 29 are created between adjacent floating vanes 27. The fixed and floating vanes 25, 27, respectively, are aligned so they extend upward and rearward into the inlet tunnel 18.

The leading edges of the fixed vane 25 and the floating vanes 27 span the width of the inlet tunnel 18 while the lateral edges thereof fit closely to the adjacent, inside surface of the inlet tunnel 18 in the closed position. The front and rear planar surfaces of the fixed vane 25 and the floating vanes 27 recede from the leading edge 28 to create a hydraulically effective angle. This angle follows the flow line to approximately match the velocity of approach of the flow of water entering into the inlet duct 17.

When the watercraft 89 is stationary or at low velocity, water is drawn into the inlet duct 17 through the articulating structure 22 via suction created by the pump 40. During this stage, the front entrance opening 19 is wide open so that all of the floating vanes 27 conform to the streamlines of water flow and act as diffusers to reduce swirl. As the watercraft's velocity increases, water enters the articulating structure 22 by the forward movement of the watercraft through the body of water 95 and by the suction of the pump 40. All of the floating vanes 27 pivot freely to an opened position by aligning in a rearward, diagonally aligned position by the flow of the incoming water. During this stage, the head on the incoming water is partially recovered at the pump 40. As the watercraft 89 further increases its velocity, the front entrance opening 19 begins to close as the flow lines through the articulating structure 22 become more widely spaced and they progress rearward. The aft-most floating vane, denoted 27A, rides on the flow line until it eventually closes against the lower front edge of the pump housing 42. At this point, the leading edge of the floating vane 27A acts as the new entrance edge for the entrance opening 19 and pressure begins to build along the gradually increasing cross-sectional area between this newly created entrance opening and the pump's impeller 46.

As the velocity of the incoming water at the entrance opening 19 relative to the velocity of the incoming water at the exit opening 20 in the inlet tunnel 18 increases, the flow lines progressively close the remaining floating vanes 27 from the aft to the fore positions. It can be seen that this has two effects—first, it reduces the effective area of the entrance opening 19; and second, it increases the effective length of the inlet duct 17. It can also be seen that the angle of approach of the streamline is always approximately aligned with the entrance angle of the vane which forms the entrance to the inlet duct 17, which is well known in the art as a design requirement for high efficiency in turbines and pumps. Further it can be seen that the changes both in cross-sectional area and in flow direction within the inlet tunnel 18 are always gradual, which are design requirements well known in the art for the efficient recovery of pressure head in turbines and venturi flow meters. By increasing the effective length of the inlet tunnel 18 and decreasing the size of the effective entrance opening 19 of the inlet duct 17, a means is provided for the efficient recovery of pressure head at every stage. The total dynamic head of the incoming water can then be recovered at the pump 40.

In the preferred embodiment, a 200 h.p. pump 40, as described below, is used. With this size of pump 40, the diameter of the discharge nozzle 60 must be 7.5 inches to achieve a watercraft velocity of 35 feet per second and below. When the boat is accelerated, the mass flow of the incoming water and the head on the pump 40 must be held constant by reducing the diameter of the discharge nozzle 60. For example, when the watercraft is operated at a velocity of 80 feet per second, the effective diameter of the discharge nozzle 60 must be reduced to 6.5 inches.

In order to maintain optimal efficiency of the inlet duct 17, the area of the front entrance opening 19 must be adjusted so that the flow of incoming water matches the watercraft's velocity in the body of water. With this particular pump 40 and effective diameter of the discharge nozzle, the minimum cross-sectional area of the front entrance area 19 of the inlet duct 17 to achieve a watercraft velocity of 80 feet per second is approximately 41 square inches. At a watercraft velocity of 35 feet per second, the cross-sectional area of the front entrance opening 19 of the inlet duct 17 must be increased to approximately 94 square inches.

Below a watercraft velocity of 35 feet per second, the discharge nozzle 60 does not open further and the flow of water through the system is reduced. At a watercraft velocity of 15 feet per second, the maximum flow of water is 1,350 pounds per second which requires a front entrance opening 19 having a cross-sectional area of approximately 202 square inches. At a watercraft velocity of 20 feet per second, the flow of water is 1,375 pounds per second which requires a front entrance opening 19 of 154 square inches.

In the pump 40, a 14 inch diameter impeller is used which rotates in an opening having a cross-sectional area of 154 square inches. In the preferred embodiment, the inlet tunnel 18 is efficiently transitioned to the hull 90 by generating curves tangent to the flow lines along the surface of the hull. This has the effect of flaring out the upper two quadrants of the circle as the inlet tunnel 18 proceeds in a forward direction until these two quadrants are substantially square at the entrance opening. By flaring the inlet tunnel 18 is this manner, the total cross-sectional area of the entrance opening 19 is increased as much as 42 square inches, thereby increasing the total cross-sectional area of the entrance opening 19 to 196 square inches. This approaches the cross-sectional area of 202 square inches required for efficient recovery by the pump 40 when the watercraft velocity is 15 feet per second.

Disposed adjacent to the exit opening 20 of the inlet tunnel 18 is the pump 40 which is coupled via a transmission 14 to an engine 13. In the embodiment shown, the pump 40 is contained in a pump housing 42 attached to or formed integrally with the inlet tunnel 18. The pump 40 is axially aligned with the exit opening 20 so that the pump shaft 44 extends forward therefrom and connects to the transmission 14. The pump 40 includes an impeller 46 which rotates to forcibly deliver the incoming water from the exit opening 20 to the discharge nozzle 60 located on the opposite side of the pump 40. The size of the pump 40 is determined by the size of the discharge nozzle 60 and the type and size of watercraft. The size of the pump 40 is limited by the space in the watercraft and production costs. In the preferred embodiment, the pump 40 is designed to be used with a 200 horsepower engine so that the mass flow equals approximately 1500 lbs/sec and the pump head is approximately 57 feet. The pump 40 uses a 14 inch impeller 46 which approximately matches the size of the outer housing 62 on the discharge nozzle 60 designed to form a 7½ inch effective nozzle opening 64. A diffuser 48 is disposed over the aft position of the pump 40 to recover the forced vortex produced by the pump 40.

The 14 inch impeller 46 must operate at about 2070 RPM to meet the head and flow requirements of the discharge nozzle 60. Unfortunately, this is too fast to avoid cavitation at low watercraft speeds with partial recovery of incoming dynamic head. This size of impeller 46 is able to operate close to full power, however, once the effective submergence reaches 14 feet at 30 FPS (20 mph). The impeller 46 is still cavitating under these conditions, and this cavitation would destroy the impeller 46 in a few months of continuous service, but it has very little effect on efficiency. The fact that the impeller 46 cavitates at speeds below 20 mph at full power, is balanced by the transient nature of that service.

Located at the aft position to the pump's diffuser 48 is the discharge nozzle 60 which includes an outer nozzle housing 62 with a retractable needle 66 disposed therein. The needle 66 is longitudinally aligned inside the diffuser's hub 49 and moves axially therein to adjust the size of the effective nozzle opening 64.

A nozzle adjustment means is connected to the discharge nozzle 60 for controlling the size of the effective nozzle opening 64, and hence the rate of flow of water through the system 10. As shown in FIGS. 6 and 7(A)–(C), the first embodiment of the nozzle adjustment means includes a pitot tube 70, a pressure conduit 72, a spool control valve 74 and needle chamber 75 disposed between the needle 66 and the hub 49. The port opening on the pitot tube 70 is disposed in a fore position to the pump's impeller 46 and is connected to the spool control valve 74 via the pressure conduit 72. The spool control valve 74 includes a piston 76 disposed inside a small inner cylinder 77 located in the hub 49. The operation of the nozzle adjustment means to control the flow of water through the system 10 is discussed further below.

The efficiency of the marine jet propulsion system is the product of three components, inlet duct, pump and discharge nozzle. The last can be taken as a constant of about 97%, leaving only the inlet duct and the pump efficiency as design considerations. The two are independent in that inlet duct efficiency does not affect pump efficiency and pump efficiency does not affect duct efficiency. Both affect system efficiency. However, the flow variations caused by the inlet duct recovery of head acting on the discharge nozzle result in inefficient pump operation, if the flow is not corrected by nozzle area adjustments.

The head on the discharge nozzle is the sum of the head on the pump and the head on the inlet duct. The flow through the discharge nozzle increases as the effective nozzle opening increases and as the square root of the head on the discharge nozzle increases. If the flow increases due to increased head, it can be reduced by reducing the effective nozzle opening. This is useful, because the flow must be constant for any given shaft RPM to maintain pump efficiency. For example, pump efficiency at full power shaft RPM requires the same flow, regardless of the head recovered in the inlet duct, which can be seen in the following.

The efficiency of the pump is a function of flow and shaft RPM. According to the widely used pump affinity relationships for any and all pumps, the best efficiency is obtained when flow Q divided by RPM N equals the constant characteristic of the pump design ($Q/N=K_Q$).

A pump's operating efficiency point has three coordinates: RPM (N), flow (Q) and head (h). Any two can be used to determine the third. In this discussion, the pump's best efficiency operating point is the particular operating point of interest. The determining affinity equations are $Q=K_Q N$ and $h=K_h N^2$, wherein $K_h$ is the head constant characteristic of the pump design. From the above, it is quickly apparent from substitution that $h=K_h (Q/K_Q)^2$. When this hydraulic condition is met, the pump is operating at its best efficiency.

Figure 7A:
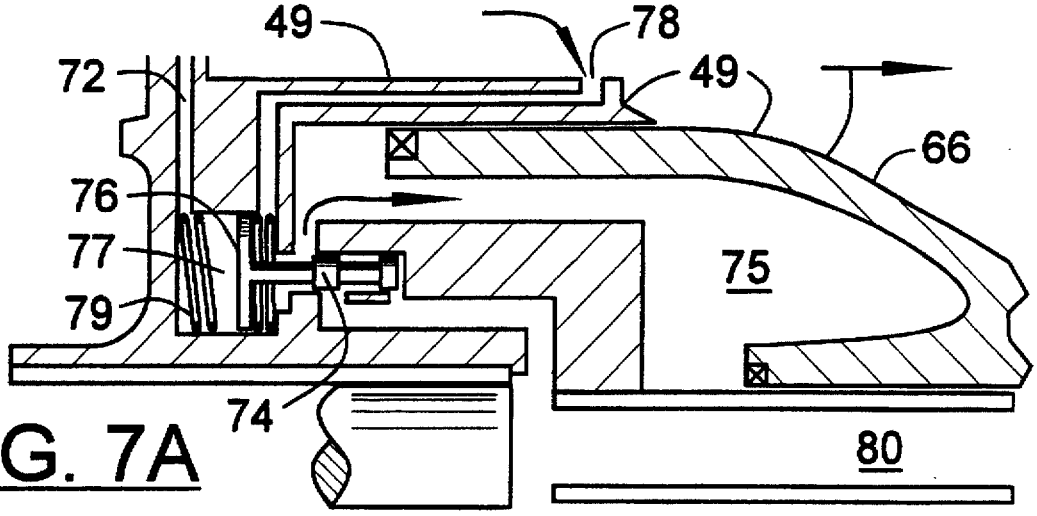
FIGS. 7(A)–(C) are illustrations showing the movement of the needle in response to the fluid flow around the needle and the piston chamber.
Figure 7B:
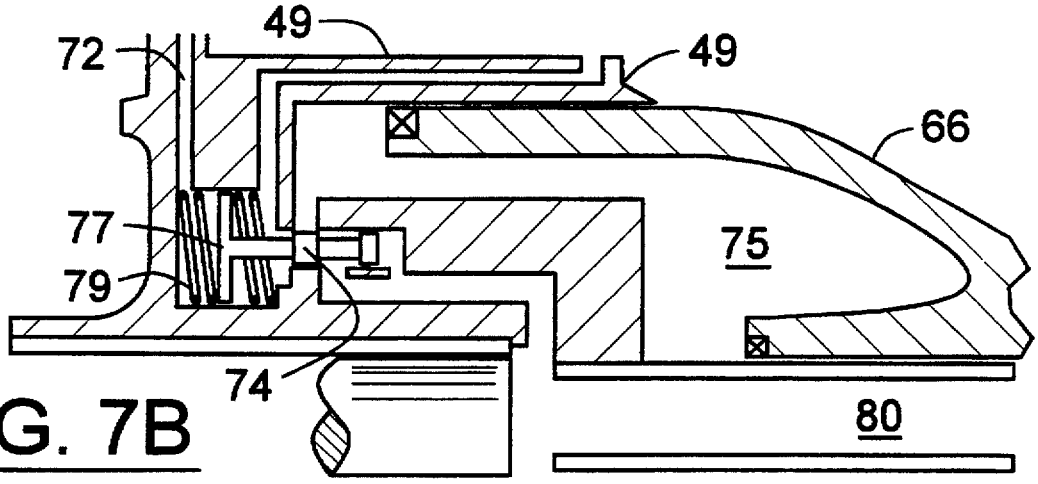
Figure 7C:
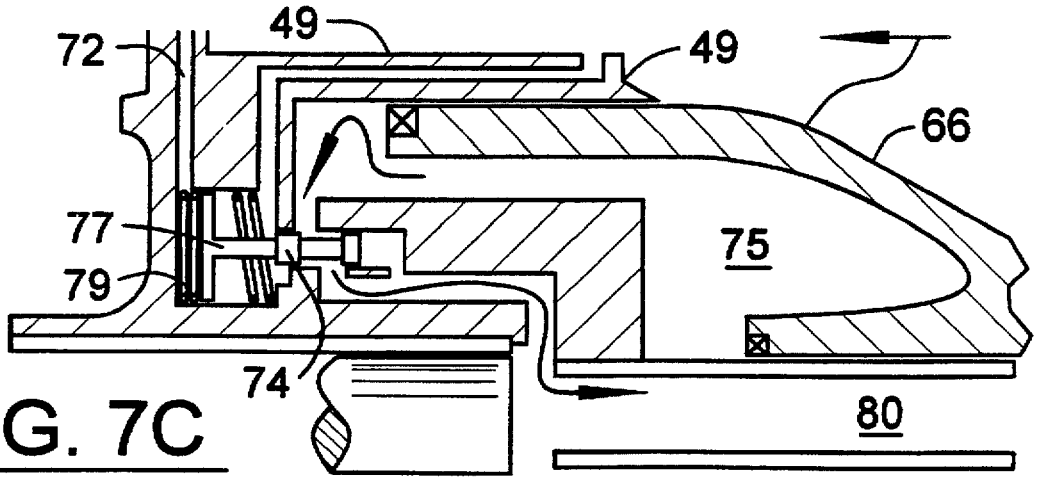

The pressures acting on the piston 76 shown in FIGS. 7A–7C will be equal when $h=K_h (Q/K_Q)^2$, or $h=k Q^2$, when the constants are combined, so the action of the 3-way control valve will maintain this condition, and consequently the efficient operation of the pump 40. This can be seen by noting that the head on the pump 40 is the difference between the pitot tube pressure $H_2$ after the pump and the pitot tube pressure $H_1$ before the pump, so that $H_2-H_1=h=k Q^2$, from which $H_2=H_1-K Q^2$. It is well known that $H_2=P_2+V_2^2/2g$ from the definition of total dynamic head and that $Q=V_2 A_2$ is the continuity condition, where Q is the flow at all cross sections, and is the product of the cross sectional area $A_2$ and the velocity $V_2$ through the section. Hence by substitution, $V_2^2=Q_2^2/A_2^2$, $H_2=P_2+Q^2/(2g A_2^2)$ and $H_1=P_2+Q^2/(2g A_2^2)-k Q^2$. When the design parameters are chosen so that $1/(2g A_2^2)=k$, the $Q^2$ terms are eliminated from the equation and maintaining $H_1=P_2$ is equivalent to maintaining $h=k Q^2$. As shown in FIG. 7C, the pressures on the piston 76 are in fact $H_1$, the pitot tube pressure ahead of the pump impeller, and $P_2$, the pressure at the fixed cross-sectional area after the pump impeller.

Figure 8:
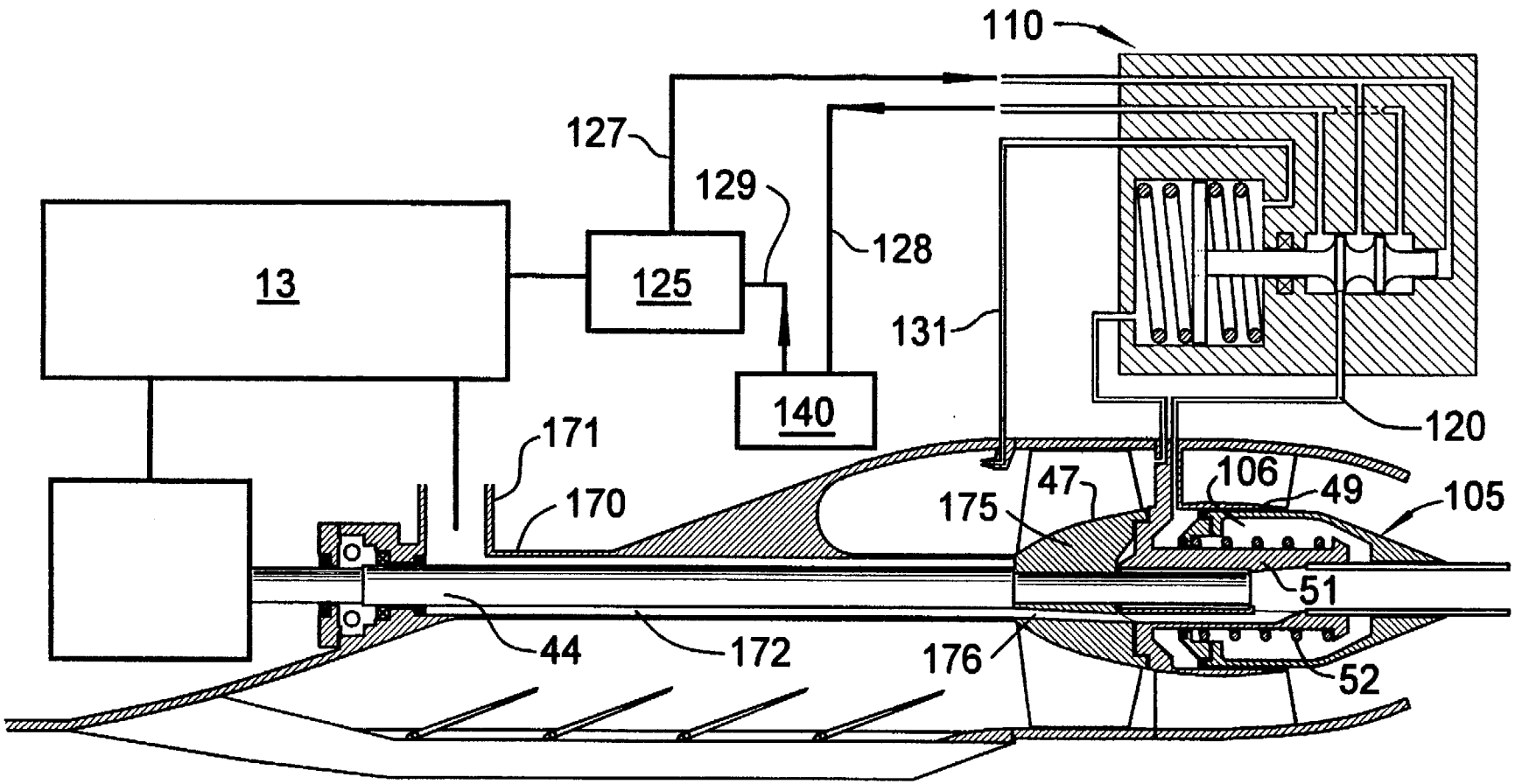
FIG. 8 is a side elevational/view of a second embodiment of the invention illustrating the use of external 3-way control valve and separate shaft-driven control pressure pump used to control the position of the needle in the discharge nozzle.
Figure 9A:
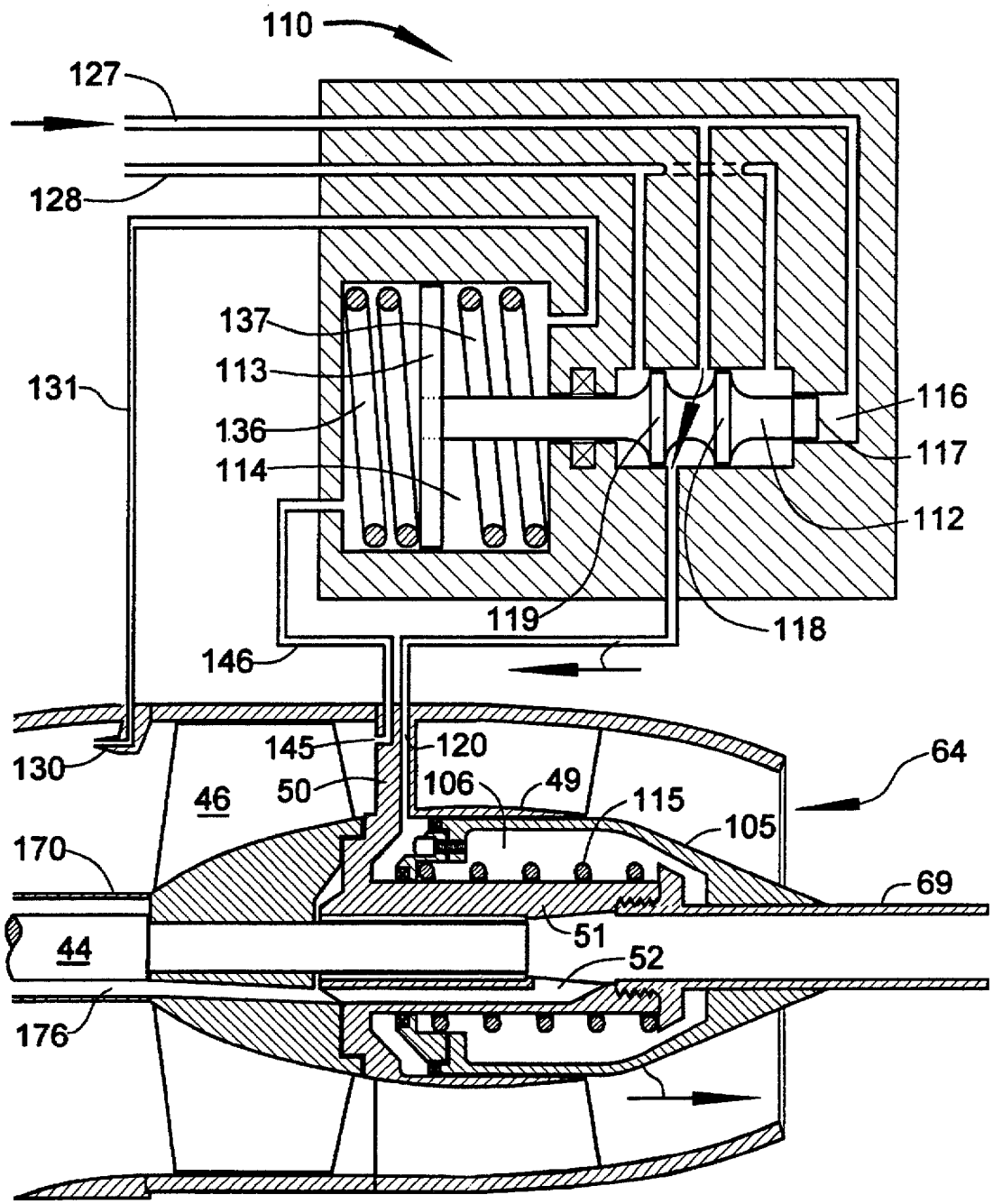
FIG. 9A is an enlarged, sectional, side elevational view of the discharge nozzle similar to FIG. 8 showing the needle at the beginning of its rearward travel from a retracted position inside the diffused hub.
Figure 9B:
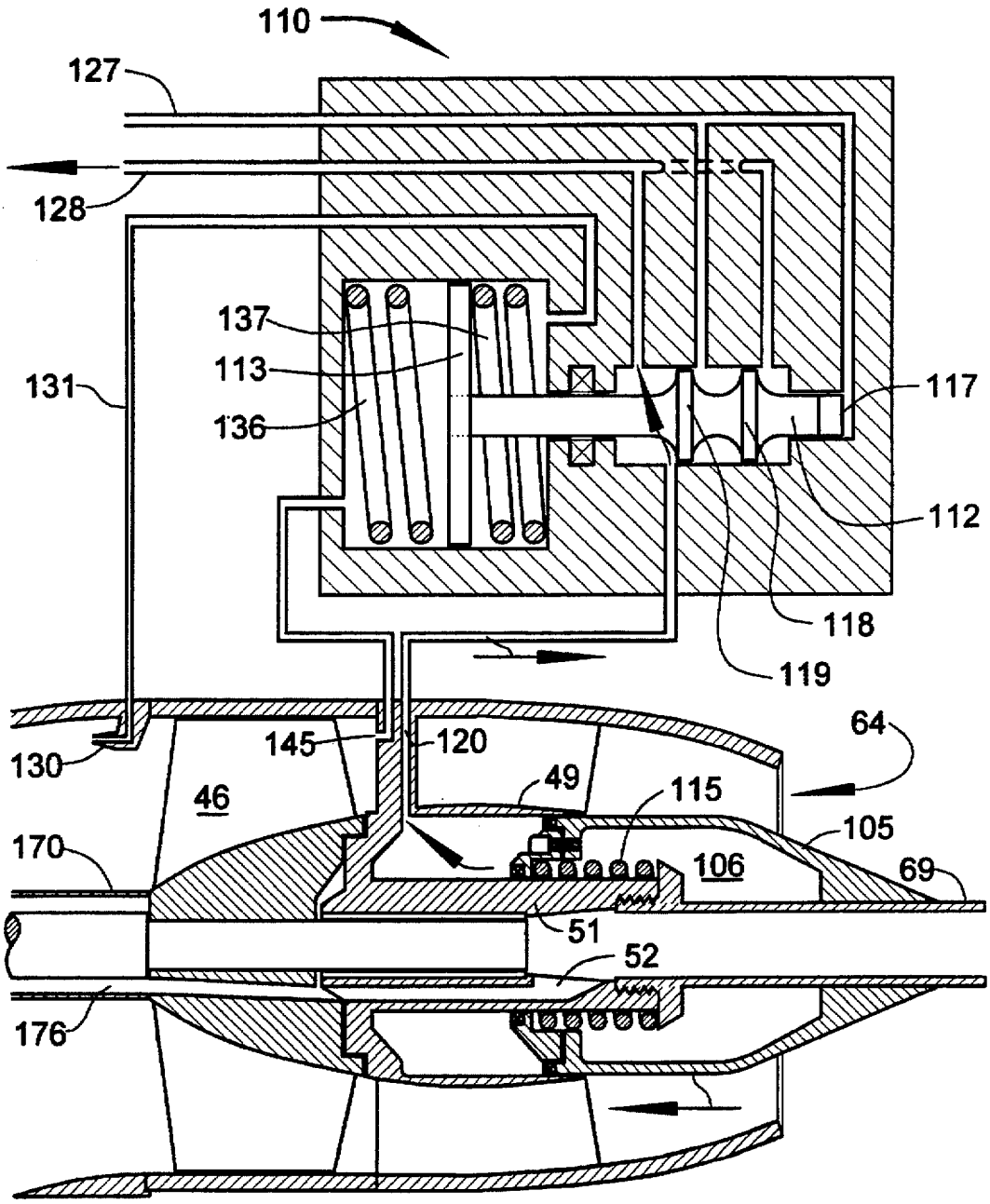
FIG. 9B is a view similar to FIG. 9A, showing the needle at the beginning of its forward travel from an extended position toward the diffuser hub.

FIGS. 8, 9A, and 9B show a second embodiment of the nozzle adjustment means comprising an external 3-way control valve 110 used to actuate the needle 105 located outside the discharge nozzle. Located inside the control valve 110 is a spool 112 disposed in a passageway 116 formed inside the control valve 110. A piston 113 is attached at one end of the spool 112 and an end plate 117 attached at the opposite end. When assembled, the piston 113 is disposed inside a piston chamber 114 formed at one end of the passageway 116. Biasing springs 136, 137 are disposed inside the piston chamber 114 on opposite sides of the piston 113 to center the spool 112 in the passageway 116.

As shown more clearly in FIGS. 9A and 9B, an isolation plug 118 is formed on spool 112 just inside the end plate 117 which is used to isolate the control fluid pressure from the drain conduit 128. A control plug 119 is formed between the isolation plug 118 and the piston 113 which is used to control the flow of the control fluid into and out of the needle chamber 106.

A control pump 125, shown in FIG. 8, is used to deliver a control fluid through a conduit 127 to the control valve 110. When the spool 112 in the control valve 110 is moved to the left as shown in FIG. 9A, the control fluid flows from the control pump 125 through the conduit 127 to the control valve 110 and then through a needle conduit 120 which runs between the passageway 116 and the needle chamber 105. When the control fluid is delivered to the needle chamber 106, the needle 105 is forcibly extended rearward from the diffuser hub 49. FIG. 9A shows the control valve 110 moved to the left to force the needle 105 rearward and shows the needle 105 at the beginning of its consequent rearward travel.

When the spool 112 in the control valve 110 is moved to the right as shown in FIG. 9B, the control fluid flows from the needle chamber 106 through the needle conduit 120, through passageway 116, and through the reservoir conduit 128 to a fluid reservoir 140. From the fluid reservoir, the control fluid is then delivered back to the control pump 125 via an intermediate conduit 129. When the control fluid flows from the needle chamber 106 to the control pump 125, the pressure inside the needle chamber 106 is reduced which allows the needle 105 to retract into the diffuser hub 49 and forces the control fluid out, of the needle chamber 106. An optional return spring 115 may be disposed inside the needle chamber 106 to apply additional force to retract the needle 105 into the diffuser hub 49. FIG. 9B shows the control valve 110 moved to the right to force the needle 105 forward and shows the needle 105 at the beginning of its consequent forward travel.

Movement of the needle 105 is controlled by maintaining the pump affinity relationship $H_2-H_1=h=K_h N^2$ on the spool 112. The three pressures are proportionate to $H_2$, $H_1$, and $N^2$, respectively, and act on the opposite sides of the piston 113 and on the end plate 117, respectively. Biasing springs 136, 137 are used to center the piston 113 and hold the control valve 110 in a closed position when the forces are balanced.

Like the first embodiment, the pitot tube 130 extends downward from the upper surface of the inlet tunnel 18 just ahead of the pump impeller 14. A pitot tube conduit 131 conducts the pressure from the pitot tube 130 to rear section of the piston 113. The pressure exerted on the rear section of the piston 113 by water entering the pitot tube 130 is a direct measurement of the total dynamic head $H_1$.

A second pitot tube 145 is incorporated in one of the vanes 50 of the diffuser 48. A second pitot tube conduit 146 conducts the pressure from the pitot tube 145 to the front section of piston 113. The pressure exerted on piston 113 by the water entering the pitot tube 145 is a direct measurement of the total dynamic head $H_2$.

The difference in these two pressures is by definition the total dynamic head h on the pump impeller 46. Hence the net force on the piston 113 is proportionate to total dynamic head on the pump impeller 46.

The third force on the spool 112 results from the action of the control fluid acting on the spool's end plate 117. The control pump 125 is of centrifugal design and produces a head pressure which is proportionate to the square of the pump shaft RPM. The control pump 125 is driven from the shaft of the motor 13, as is the pump impeller 40, so the control pump shaft RPM is proportionate to the impeller's shaft RPM. Hence, the force on the piston 113 is proportionate to the square of the impeller's shaft 44 which is $N^2$.

When the net forces on the piston 113 and the end plate 117 are equal, the two biasing springs 136, 137 act against the piston 113 to center the spool 112 in the passageway 116, thereby holding the needle 105 in a fixed position in the diffuser hub 49. The pump design constants, drive ratios, and piston areas are so chosen that this condition corresponds to the pump affinity relationship $h=k_h N^2$.

As shown in FIG. 9A, when the combined forces on the piston 113 and the end plate 117 are greater than the opposing force exerted on the piston 113 from the pitot tube 145, the spool 112 is forced to the left which, in turn, compresses the biasing spring 136. The control fluid is then allowed to flow from the control pump 125 into the needle chamber 106 and extend the needle 110 from the diffuser hub 49. This has the effect of reducing the effective nozzle opening 64, which restricts the flow and holds an increased head on the pump impeller 46. The increased pump head is seen as an increased force on the piston 113, which continues until the force on the piston 113 is in balance with the force on the end plate 117, the piston 113 is again centered by the biasing springs 136, 137, in the piston chamber 114, and the needle 105 is again locked in place.

As shown in FIG. 9B, when the combined forces on one side of the piston 113 and the end plate 117 is less than the force exerted on the opposite side of piston 113 from the second pitot tube 145, the spool 112 moves to the right as shown in FIG. 9B, which compresses the biasing spring 137. The force of the return spring and the external pressure exerted on the needle 105 then forces the control fluid to flow from the needle chamber 106 to the reservoir conduit 128, which allows the needle 105 to retract into the diffuser hub 49. This has the effect of increasing the effective nozzle opening, which allows more flow and holds a reduced head on the pump impeller 40. The reduced pump head is seen as reduced force on the piston 113, which continues until the force on the piston 113 is in balance with the force on the end plate 117, the piston 113 is again centered in the biasing springs 136, 137, and the needle 105 is again locked in place.

It should be understood that the pitot tube 130 can be located at any position inside the inlet tunnel 18 downstream from the inlet duct's front entrance opening 19, because the total dynamic head changes very little along an efficient inlet duct. Similarly, the second pitot tube 145 can located at ant position on the diffuser 48 or discharge nozzle because the total dynamic head changes very little in these hydraulically efficient ducts.

Figure 10:
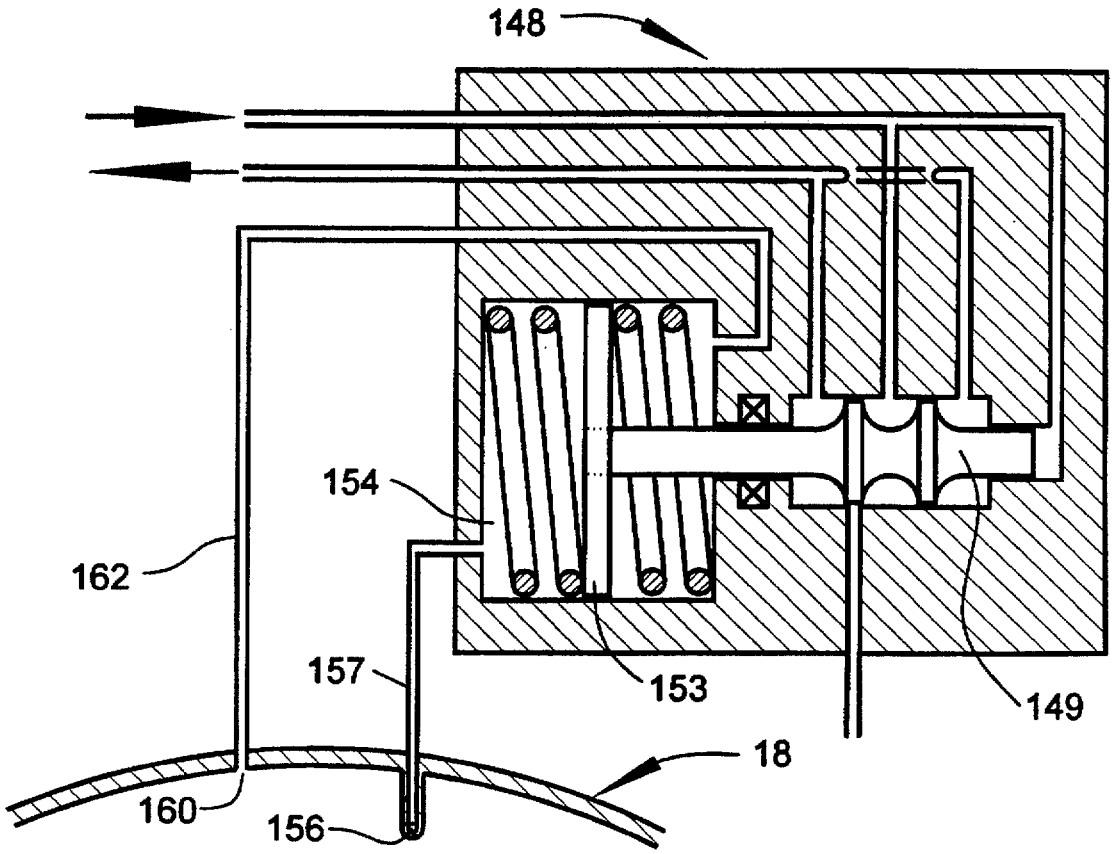
FIG. 10 is a sectional view of a third embodiment of the invention taken perpendicular to the system flow at a plane with fixed flow cross-section.

FIG. 10 shows an external control valve 148 for a third embodiment, which is similar in action to the second embodiment described above, except that the pressures and areas on the spool 149 are chosen to maintain the affinity relationship $Q=K_Q N$.

The force on the piston 153 of the control valve 148 is again proportionate to $N^2$ as in the previous embodiment. To achieve a balance of forces when $Q=K_Q N$, the design requires a force proportionate to $Q^2$, so that the balance of forces on the spool 149 can be based on the equivalent relationship $Q^2=K_Q{}^2 N^2$.

In FIG. 10, the pitot tube 156 extends downward from the upper surface of the inlet tunnel 18 just ahead of the impeller (not shown). A conduit 157 connects the pitot tube 156 to the front section of the piston chamber 154 of the control valve 148 on which it produces a force proportionate to total dynamic head at the flow cross-section.

A pressure port 160 is located adjacent to the pitot tube 156 in a plane perpendicular to the flow. A conduit 162 connects the pressure port 160 to the rear section of the piston chamber 154 on which it produces a force proportionate to the pressure at the cross section.

Total dynamic head is the sum of the pressure head and the velocity head, that is $H=p+V^2/2g$. The net force on the piston 153 resulting from the pitot tube pressure H opposed by the pressure p is H−p, which is $V^2/2g$, so the net force on the piston 153 is proportionate to $V^2$. The cross sectional area is constant, so the net force on the piston 153 is also proportionate to $Q^2$ based on continuity. Hence the net force on the piston 153 is proportionate to $Q^2$ and is opposed to the force on the end plate 117, which is proportionate to $N^2$. The size of the piston 153, the end plate 117 and the pump design parameters are chosen so that the forces on the spool are balanced when $Q^2=K_Q^2 N^2$ which is equivalent to the affinity relationship $Q=K_Q N$.

From this, it should be understood that the three pump affinity relationships, which must be maintained for optimal pump efficiency, are $h=k Q^2$, $h=K_h N^2$, and $Q=K_Q N$. It should also be understood that maintaining any one of these affinity relationships is a necessary and sufficient condition for maintaining the other two. The embodiment shown in FIGS. 1, 6, 7A–C maintains the relationship $h=k Q^2$, the embodiment shown in FIGS. 8, 9A, and 9B maintains the relationship $h=K_h N^2$, and the embodiment of FIG. 10 maintains the relationship $Q=K_Q N$. Each of these devices is in fact fully effective in maintaining all three pump affinity relationships.

FIGS. 8, 9A and 9B show the engine exhaust being discharged through the large discharge nozzle 60. An exhaust tube 170 is shown which runs coaxially about the pump shaft 44. The exhaust is delivered into a transition tube 171 connects to the exhaust tube 170. A coaxial passageway 172 is formed between the exhaust tube 170 and the pump shaft 44.

The impeller hub 47 is cast with alternate spokes 175 and passageways 176, through which the exhaust passes to the diffuser hub 49, which is also cast with alternate spokes 51 and passageways 52, through which the exhaust is delivered into the needle aligning tube 69 and therethrough into the center of the discharge opening 64. It should be noted that this through-the-jet exhaust is greatly facilitated by the large-nozzle geometry, which allows adequate room for the free passage of the motor exhaust that is not available in the water jet propulsion systems of the prior art.

OPERATION OF THE INVENTION

All of the above embodiments of nozzle adjustment operate in the same manner by maintaining one of the pump affinity relationships discussed above.

When the first embodiment of the system is incorporated into a watercraft and the watercraft is either stationary or moving at very low speed, no pressure is recovered in the inlet duct 17 and the pump 40 is operating in a suction mode. All of the floating vanes 27 in the inlet duct 17 are in an open position and act to diffuse the flow of water therein. The balance of forces moves the piston 76 to the forward position. The needle 66 is fully retracted in the outer housing 62. The effective nozzle opening 64 is then at a maximum. The pump's impeller 46 and discharge nozzle 60 are designed so that the pump 40 operates at less than peak efficiency flow under this condition. This nozzle restriction reduces both the flow and the hydraulic efficiency of the pump 40, which produces higher head and demands more power from the engine 13. The power is readily available because the engine 13 can supply substantial power in excess of the cavitation limit of the pump 40. Part of the power that would have been consumed during cavitation is lost to the lower hydraulic efficiency of the pump 40, but the reduced-flow operation has the net effect of maximizing the hydraulic power delivered by the pump 40 to the discharge nozzle 62. As a result, the smaller effective nozzle opening produces greater thrust than would be produced by a larger effective nozzle opening, which would be required to maintain the pump's peak hydraulic efficiency in the absence of cavitation.

As the water craft's speed increases, the inlet duct 17 recovers part of the available total dynamic head and becomes fully effective when the velocity of the watercraft 89 reaches approximately 30 feet per second (20 mph).

At this boat speed, the velocity of the water entering the inlet duct 17 matches the velocity of the watercraft 89 in the body of water. This boat speed is typically the peak hull drag at its greatest wave-making losses as the watercraft 89 is coming up on plane. At this velocity, the inlet duct 17 recovers about 14 feet of total dynamic head at the pump's impeller 46. This head is effective submergence of the pump 40 and acts to suppress cavitation. The 14 feet of total dynamic head is also additive to the pump head at the nozzle, increasing flow to that required for the pump's most efficient operation, such operation being no longer limited by cavitation under said 14 feet of effective submergence. These hydraulic conditions allow full power operation without significant cavitation losses. The inlet duct 17, the pump 40, and the discharge nozzle 60 are now operating close to maximum efficiency at any shaft power up to full design power.

When describing the operation of the first embodiment of the invention, the total dynamic head of the incoming water in the inlet tunnel 18 at the exit opening 20 is converted to pressure in the pitot tube 70. This pressure acts through the pressure conduit 72 on the piston 76 in the spool control valve 74 to produce a motive force.. The pressure component of the total dynamic head after the pump 40 is then delivered through the pressure port 78 on the hub 49 which creates a motive force on the inside surface of the piston 76 located in the needle chamber 75. The design is such that these two forces exerted on the piston 76 are in balance whenever the pump 40 is operating at best efficiency.

If the flow f(1) is too high for the head being produced by the pump 40, the net motive force on the piston 76 moves the spool control valve 74 to allow water from the pressure port 78 to flow from the piston chamber 77 and into the needle chamber 75, which advances the needle 66, as shown in FIG. 7A. This, of course, reduces the effective area of the nozzle opening 64 and reduces the flow therethrough. With the reduction of flow through the nozzle opening 64, the forces exerted on the opposite sides of the piston 76 are balanced which, in turn, causes the spool control valve 74 to move back into a neutral position so that no water flows either into or out of the piston chamber 75 as shown in FIG. 7B.

The biasing spring 79 disposed inside the piston chamber 77 is used to make the spool control valve 74 movement proportional to the net motive force on the piston 76, and this provides stable operation, as is well known in the art.

If the flow f(1) is two low, the net motive force on the piston 76 acts to move the spool control valve 74 in a forward direction, which compresses the biasing spring 79 as shown in FIG. 7C. When sufficient force is exerted on the piston 76, the spool control valve 74 opens the piston chamber 77 to the drain 80, thereby allowing the water in the piston chamber 77 to flow f(5) into the drain 80. The pressure in the outer housing 62 acts against the outer face of the needle 66 to force the needle 66 longitudinally back into the hub 49. This movement forces the water from the needle chamber 75 and into the drain 80. As the needle 66 retracts, the effective nozzle opening 64, and hence the flow f(1), increases until the motive force on the piston 76 and biasing spring 79 again returns the spool control valve 74 to its neutral position as shown in FIG. 7B.

As one can see, the needle 66 adjusts so that the pump 40 operates at its optimal efficiency, regardless of the total dynamic head in the inlet duct 17 or the shaft RPM. Similarly, the inlet duct 17 can be seen to effectively recover the total dynamic head at any watercraft 89 speed greater than the design minimum and any pump shaft RPM less than the design maximum, because the effective area of entrance opening area of the inlet duct 17 must be reduced with either higher velocity or lower power.

As mentioned above, the floating vanes 27 on the inlet duct 17 ride on the flow lines of the water flow field in the inlet duct 17. Such flow fields, composed of stream lines and pressure isobars perpendicular thereto, are well known in the art of pump and turbine designs. In the absence of the floating vanes 27, the flow of water into the middle of the inlet duct 17 would be rejected out of the back of the inlet duct 17 and this loss of flow could be seen to increase with increased velocity of the watercraft 89 and decrease the inlet duct's recovery of pressure. This outflow at the back of the inlet duct 17 is the major source of inlet duct inefficiency in the prior art.

In the invention disclosed herein, the anterior floating vane 27A prevents this outflow when the flow line carries it up against the articulating structure 22 which prevents it from releasing the flow. The flow, thus trapped above the anterior floating vane 27A, acts fully against the impeller 46, and the inlet duct 17 is now defined by the leading edge of the aft vane, denoted 27A. It can be seen that the entrance area of the inlet duct 17 is effectively reduced by the closing of this vane, because its leading edge forms a smaller duct opening than does its trailing edge due to the incline geometry of the inlet duct.

As the watercraft 89 approaches top speed at the full power required to overcome hull drag, all of the floating vanes 27 in the inlet duct 17 are closed by the flow across the cross section area of the first inlet opening 26, which becomes the total system flow at the relative velocity of the water across the area of the fixed inlet.

At top speed, it can also be seen that the needle 66 will be fully extended to reduce the effective nozzle opening 64, because this speed produces the greatest pressure recovery in the inlet duct 17.

In the preferred embodiment discussed above, the system 10 can also be seen to operate efficiently at the watercraft's most efficient planing velocity of approximately 45 feet per second. At this velocity, the inlet duct 17 recovers approximately 30 feet of total dynamic head at the pump's impeller 46. With the reduced hull drag at the typical hull's most efficient planing velocity, the required pump shaft power is reduced to approximately 25% of maximum. The low shaft power at this watercraft velocity requires reduction of flow for efficient pump operation, and the needle 66 is fully extended to reduce the effective nozzle opening 64. The pump 40 is operating under conditions which are suitable for long term commercial operation in accordance with the standards of the Pump Institute. Commercial pumps of this size commonly achieve efficiencies around 85% under these conditions.

If the shaft power is increased rapidly to full power, while the boat speed is held at 45 fps, the effective nozzle opening 64 will increase to allow the higher flow required by the pump 40 at the higher shaft power. The rate of change is limited by the flow from the needle chamber 75 to the drain 80 via the spool control valve 74. The inertia of the engine and transmission limit the rate of change of the shaft speed, and the increased nozzle pressure caused by a lag in the needle 66 response acts to increase the rate of correction, both of which are natural stabilizing effects to the control response. The inlet duct 17 will independently open to supply the greater system flow and will still recover the same 30 feet of total dynamic head against the impeller 46, except that the velocity component will be higher and the pressure component, correspondingly lower.

From this, it can be seen that the inlet duct 17 and the discharge nozzle 62 are able to simultaneously maintain efficient recovery of the power in the relative velocity of the water, efficient operation of the pump 40, and high propulsion efficiency characteristic of the large nozzle over all boat speeds above 30 fps and over all pump shaft power levels above what is required to overcome hull drag.

It can also be seen that the combined use of the inlet duct 17 and the discharge nozzle 60 require a larger range of action in each than would be required if the inlet duct 17 or discharge nozzle 60 were used singularly. For example, the entrance area of the inlet duct 17 must be largest at low watercraft velocities when the effective nozzle opening 64 is at its maximum setting. The entrance area of the inlet duct 17 must be smallest at high watercraft velocities and when the effective nozzle opening 64 is at its minimum setting.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. An improved discharge nozzle having an effective nozzle opening for a marine jet propulsion system in a watercraft passing at a velocity through a body of water, the marine jet propulsion system having a pumping means, an inlet duct to receive water from the body of water and direct the received water to the pumping means, and a discharge nozzle to receive water exiting from the pumping means and discharge the received water from the watercraft, said discharge nozzle including:

a nozzle adjustment means capable of adjusting said effective nozzle opening according to a pump affinity relationship.

2. An improved discharge nozzle for a marine jet propulsion system as recited in claim 1, wherein said pumping means has a shaft speed, said pumping means is subjected to a head and flow, and said pump affinity relationship is maintained so that the head and flow on the pumping means are maintained at the most efficient values for the pumping means' shaft speed.

3. An improved discharge nozzle for a marine jet propulsion system as recited in claim 2, wherein said head and flow on the pumping means are maintained at their most efficient values by adjusting said head and flow so that the ratio of the square of said flow to said head is maintained at a value that is characteristic of the most efficient value of the pumping means.

4. An improved discharge nozzle for a marine jet propulsion system as recited in claim 2, wherein the head and flow on the pumping means are maintained at their most efficient values by adjusting said head and flow so that the ratio of the square of said shaft speed to said head is maintained at a value that is characteristic of the most efficient value of the pumping means.

5. An improved discharge nozzle for a marine jet propulsion system as recited in claim 2, wherein the head and flow on the pumping means are maintained at their most efficient values by adjusting said head and flow so that the ratio of said flow to said shaft speed is maintained at a value that is characteristic of the most efficient value of the pumping means.

6. A method for maintaining the pump efficiency of a jet propulsion system for a watercraft including an inlet duct, a pump, and an adjustable discharge nozzle, the watercraft passing at a velocity through a body of water, the pump having a shaft speed in a range of shaft speeds, said method including the following steps:

a) selecting an adjustable discharge nozzle capable of maintaining a pump affinity relationship of said pump when operating at all shaft speeds in the range of shaft speeds;

b) operating the pump to adjust the velocity of said watercraft through the body of water; and, c) adjusting the adjustable discharge nozzle so that the pump affinity relationship is maintained at all shaft speeds at which the pump is operated.

7. A watercraft, comprising:

a hull suitable for passage relative to a body of water;

an engine located in the hull; and a water jet propulsion system connected to the engine, the water jet propulsion system including:

a pumping means, an inlet duct to receive water from the body of water and direct the received water to the pumping means, and a discharge nozzle to receive water exiting from the pumping means and discharge the received water from the watercraft, said discharge nozzle including:

a nozzle adjustment means for adjusting said effective nozzle opening according to a pump affinity relationship.

8. A method for propelling a watercraft relative to a body of water, comprising the steps of:

a) providing a hull suitable for passage relative to the body of water;

b) locating an engine in the hull;

c) providing a pumping means;

d) connecting the pumping means to the engine;

e) providing an inlet duct to receive water from the body of water and direct the received water to the pumping means; and f) providing a discharge nozzle to receive water exiting from the pumping means and discharge the received water from the watercraft, said discharge nozzle including a nozzle adjustment means for adjusting said effective nozzle opening according to a pump affinity relationship.

* * * * *